United States Patent [19]

Dietzel

[11] 4,072,266

[45] Feb. 7, 1978

[54] CENTRIFUGE, ESPECIALLY FOR THE SUGAR INDUSTRY

[75] Inventor: Walter Dietzel, Braunschweig, Germany

[73] Assignee: Braunschweigische Maschinenbauanstalt, Braunschweig, Germany

[21] Appl. No.: 690,536

[22] Filed: May 27, 1976

[30] Foreign Application Priority Data

June 19, 1975 Germany ..... 2527227
June 19, 1975 Germany ..... 7519445[U]

[51] Int. Cl.[2] ..... B04B 15/06
[52] U.S. Cl. ..... 233/2; 127/19
[58] Field of Search ..... 233/1 R, 1 E, 2, 27; 210/380, 369; 127/19, 56

[56] References Cited

U.S. PATENT DOCUMENTS

| | | | |
|---|---|---|---|
| 1,946,500 | 2/1934 | Roberts | 233/2 X |
| 2,028,168 | 1/1936 | Roberts | 233/2 X |
| 2,495,817 | 1/1950 | Olsen et al. | 233/1 E |
| 2,683,562 | 7/1954 | Ranseen | 233/2 X |
| 3,151,072 | 9/1964 | Dietzel et al. | 233/1 E |
| 3,250,391 | 5/1966 | Pause | 210/380 X |
| 3,955,754 | 5/1976 | Schaper | 233/2 |

FOREIGN PATENT DOCUMENTS

| | | | |
|---|---|---|---|
| 1,209,955 | 10/1963 | Germany | 233/2 |

*Primary Examiner*—George H. Krizmanich
*Attorney, Agent, or Firm*—W. G. Fasse; W. W. Roberts

[57] ABSTRACT

In a centrifuge, the centrifuge baskets may be conical or cylindrical, and the inner surface of the basket is provided with grooves or a mesh for forming flow-off paths. A screen is supported inside of a centrifugal drum, basket, or cage. The screen may rest on the inner surface of the drum, cage, or basket, or support members may be interposed between the screen, and the drum, basket or cage. In any event, passageways are provided between the screen and the rotating centrifugal member such as a drum, basket, or cage. The radially outer surfaces of the screen are at least partially roughened, and corresponding contact areas of the supporting surface are also roughened, in order to increase the friction at said contact areas.

14 Claims, 10 Drawing Figures

CENTRIFUGE, ESPECIALLY FOR THE SUGAR INDUSTRY

BACKGROUND OF THE INVENTION

This invention relates to centrifuges especially for the sugar industry. Such centrifuges may be of the continuously operating type or of the batch type. Both types of centrifuges have a rotatable centrifuge member such as a drum or cage supporting a screen and liquid flow-off paths on the radially inner surface of the rotating member facing said screen which rests in contact against said inner surface or against a separate support member. While the invention disclosed herein has particular reference to the sugar industry, it will be appreciated that the invention is not limited to such application.

In centrifuges of the above type, the liquid flow-off paths may be formed as grooves in the inner surface of a rotatable drum. In this case, the screen may rest directly on the radially inner surface of the basket. Alternately, the liquid flow-off paths may be formed by a mesh interposed between the inner surface of the rotating member and the screen proper. The invention is equally useful to either of these structures.

In one type of continuously operating centrifuges, the centrifuge basket and screen are conical. The screen is fixed to the basket at the smaller diameter end of the basket, by securing means, for example, by means of a clamping ring. Such securing means are well known in the art. In the past, this technique for mounting the screen has proved to be satisfactory. However, increases in the diameters of the rotating members, increases in the quantity of material treated, as well as increases in operating speeds exposed the screens of such centrifuges to increasing loads especially at the point at which they are rotating the member such as the centrifuge basket. This increased loading of the screens is particularly disadvantageous if very fine screens having rather small screen holes or slots are employed, since, for reasons of manufacture, the thickness of the screens decreases proportionally with the size or width of the screen holes.

Batch type centrifuges generally have cylindrical rotating members such as drums and mechanical discharging and conveying devices for discharging and conveying the centrifuged material. In such centrifuges, apart from possible corrosion caused by the handling of chemically active products, there are mainly two causes for the wear and possible destruction of the screen. On the one hand, wear and destruction may be caused by compressive stress exerted on the screen under normal working conditions during the centrifuging process by the layer of the product to be centrifuged, or, by the solid matter on the screen, and certain tensile stresses may occur on the screen if the centrifuge basket is exposed to elastic strain under the influence of the normal working load. On the other hand, extra wear and tear occurs during discharge operations. Discharging is effected at a relatively low speed, as compared with the centrifuging, speed, and mechanical equipment such as discharger plows, scrapers or the like are employed for removing the solid matter, for example, the sugar from the screen. During this discharging operation, the cover screen is subjected to shearing forces which are directed in parallel to its surface. These forces tend to expand the screen in the circumferential direction, or alternately, to displace the screen. In both cases, the generally fine meshed and thin cover screen is subjected to stresses which may damage or even destroy the screen.

The mentioned damaging effect due to the stresses on the screen is essentially the same in centrifuges having a backing mesh, as in centrifuges having grooves in the basket wall for liquid discharge. The conditions are also similar in the centrifuges having conical rotatable baskets as well as cylindrical rotatable drums. In each case, the generally fine cover screen is exposed to forces acting substantially parallel to the screen surface.

OBJECTS OF THE INVENTION

In view of the above it is the aim of this invention to achieve the following objects, singly or in combination:

to improve a centrifuge especially a sugar centrifuge of the continous or batch type so as to overcome the above problems of known centrifuges;

to provide a centrifuge wherein the effects of stresses on the screen due to increasing basket diameters, increasing loads, and increasing speeds, as well as stresses caused by mechanical discharging or conveying devices, are minimized:

to provide means for increasing the permissible loads at the points where the screen is secured to a conical centrifuge basket, that is at the smaller diameter end of the conical basket; and to provide a centrifuge wherein the radially outer surface of the screen is roughened at least in some areas, and the radially inner surface of the basket is also roughened in corresponding or registering areas, to inhibit relative movement between the screen and the basket structure by the resulting increased friction.

SUMMARY OF THE INVENTION

In accordance with the invention, the above objects are achieved by providing a rough surface on at least some radially outwardly facing areas of the screen, and by providing corresponding rough surfaces on the radially inner surface of the centrifuge basket, or the centrifuge drum and/or the supporting devices for the screen whereby the resulting friction at the points or areas of contact between the screen and rotating means provide forces which counteract the undesirable forces on the screen in operation.

The gist of the invention resides in relieving delicately constructed centrifugal cover screens during operation from loads imposing extra wear and tear on such screens. Such relief is accomplished by a frictional resistance locking between the screen and the means which support the screen in the centrifuge. This teaching is applicable to all types of centrifuges including those in which forces effective in parallel to the screen surface are caused by mechanical feed advance means for the material to be centrifuged, for example, so-called worm type centrifuges and pusher type centrifuges. In these last mentioned types the centrifugal force assures that the screen loaded by material to be centrifuged is locked by a frictional resistance contact to the support means at least in the areas with the roughened surfaces. This has the advantage that said forces and respective loads are directly transmitted from the screen to the support means such as the basket or drum or source intermediate support elements between the screen and the rotating member forming a basket or drum.

BRIEF FIGURE DESCRIPTION

In order that the invention will be more clearly understood, it will now be described in greater detail by way of example with reference to the accompanying drawings, wherein.

Figure 1:
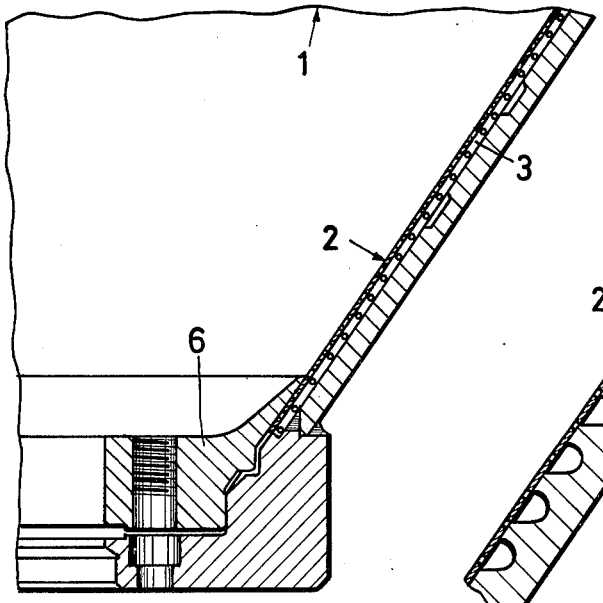
FIG. 1 is a sectional view of a portion of the basket of a centrifuge, in accordance with one embodiment of the invention, wherein a supporting mesh is arranged between the screen proper and the basket wall.

DETAILED DESCRIPTION OF PREFERRED EXAMPLE EMBODIMENTS:

FIG. 1 shows a cross sectional view of a portion of a centrifuge having a conical centrifuge basket 1. These centrifuges are know as such. A supporting or backing mesh 3 is located on the radially inner surface of the basket 1, and a screen 2 rests against the raised inner surfaces of the backing mesh 3.

In operation, the product such as sugar juices to be centrifuged is fed in the centrifuge at the smaller diameter end of the centrifuge basket, that is, at the bottom of the basket. The product then flows in the direction toward the larger diameter end of the basket under the influence of centrifugal force due to the rotation of the basket, as well as due to forces exerted in this direction by the product later introduced into the basket. As the product thus moves outwardly, liquid is removed therefrom due to the centrifugal force and the liquid passes through the screen while the solid matter remains on the screen and is discharged over the larger diameter upper edge of the basket. Thus, the centrifuge illustrated in FIG. 1 may be operated continuously.

Figure 2:
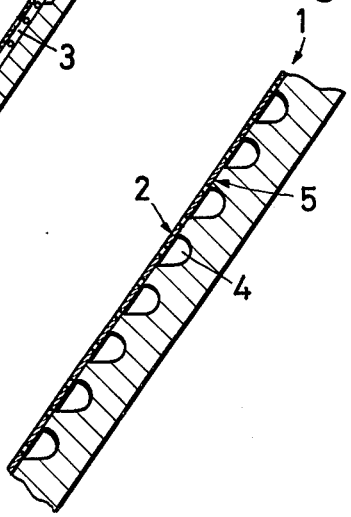
FIG. 2 is an enlarged cross sectional view of a modification of the structure of FIG. 1, wherein the radially inwardly facing wall of the basket is provided with grooves.

In the centrifuge illustrated in FIG. 1, the liquid flow-off paths are formed below the screen by the supporting and backing mesh 3. In the variation of the centrifuge as illustrated in FIG. 2, however, the backing mesh is omitted. Liquid flow-off paths are formed in this arrangement by grooves 4 in the centrifugal basket 1 itself, and the screen is supported by the webs 5 between adjacent grooves 4, so that the screen rests directly on the inner surface of the centrifugal basket 1.

Referring again to FIG. 1, a clamping ring 6 is provided at the smaller diameter end of the centrifuge basket. This clamping ring clamps the screen 2 between the wall of the centrifuge basket and the flank of the clamping ring 6. Other means for securing the screen to the smaller diameter end of the basket may be employed alternately.

Figure 3:
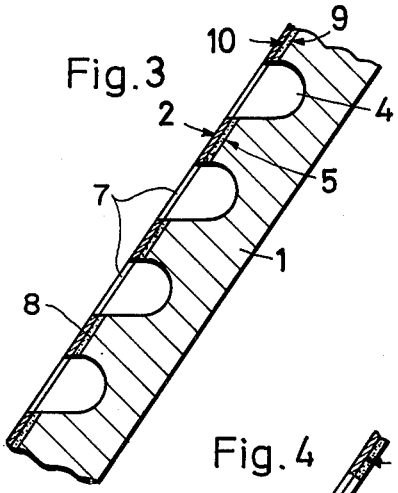
FIG. 3 is an enlarged cross sectional view of a portion of the structure of FIG. 2 with grooves in the basket wall.
Figure 5:
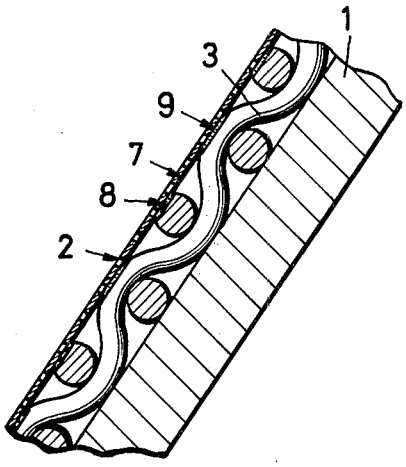
FIG. 5 is an enlarged view of a portion of the arrangement of FIG. 1.

The manner of supporting the screen 2 according to the invention as illustrated in FIGS. 1 and 2 relieves the screen 2 of undesirable loads, mainly in the areas where it is secured to the conical centrifuge basket. The invention also makes sure that the screen is self supporting substantially on its entire surface with respect to forces which are directed parallel to the screen surface. This is achieved by providing radially outer surface areas 7 of the screen 2 with rough zones 8, and by providing corresponding zones on the radially inwardly facing supporting surfaces of the supporting mesh 3 as illustrated in FIG. 5 Alternately, the cooperating areas or zones 8, 9 may be located on the screen and on the supporting surfaces of a centrifuge basket 1 as illustrated in FIG. 3. Due to the cooperation of these rough areas or zones 8, 9 a frictional resistance is provided therebetween under the influence of the centrifugal force. This frictional resistance holds the screen in place and prevents it from moving or stretching in the direction of the generatrix of the basket cone, or in the direction of the circumference of the centrifuge basket 1.

In the past, partly for reasons of manufacture and partly in order to avoid incrustation, the surfaces of the screen and supporting devices such as the intermediate mesh or the radially inside surface of the centrifuge basket, were made smooth. However, in accordance with the invention certain zones or areas of these surfaces are intentionally roughened, so that, under the influence of the centrifugal force, a highly frictional resistance is provided between the screen and its supporting surfaces. This frictional resistance makes the screen self supporting substantially on its entire surface with respect to all forces directed parallel to the screen surface. Hence, only relatively small forces are transmitted to the point at which the screen is secured to the centrifuge basket.

In the centrifuge illustrated in FIG. 1, the load component on the screen in the direction of the cone generatrix has a magnitude which depends on the rotational speed of the basket, the radius or the distance from the rotation axis of the mass of the screen, and the load caused by the weight on the screen. The load relieving effect of the frictional resistance in accordance with the invention is achieved since the load component is counteracted by a force which increases with the friction coefficient of the contact surface areas between the screen and the supporting structure. In known centrifuges, this counteracting force was relatively small due to the smooth contact surfaces having a respectively small coefficient of friction. As a result, the major part of the force on the screen in the direction of the cone generatrix acted on the screen as a tensile force. This tensile force is avoided in the arrangement of the invention due to the frictional resistance as above described. This frictional resistance, in accordance with the invention, is also effective with respect to forces acting on the screen in a circumferential direction. Such circumferential forces result when the product to be centrifuged is accelerated due to the increase in circumferential speed of the product as it moves from the smaller diameter end of the centrifuge basket to the larger diameter end thereof.

Figure 4:
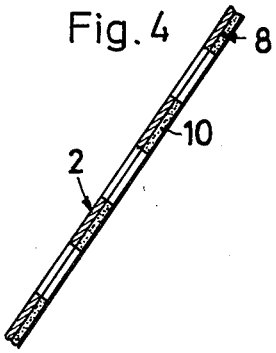
FIG. 4 is an enlarged sectional view of a screen which may be employed in the arrangements of FIG. 1 and 2.
Figure 6:
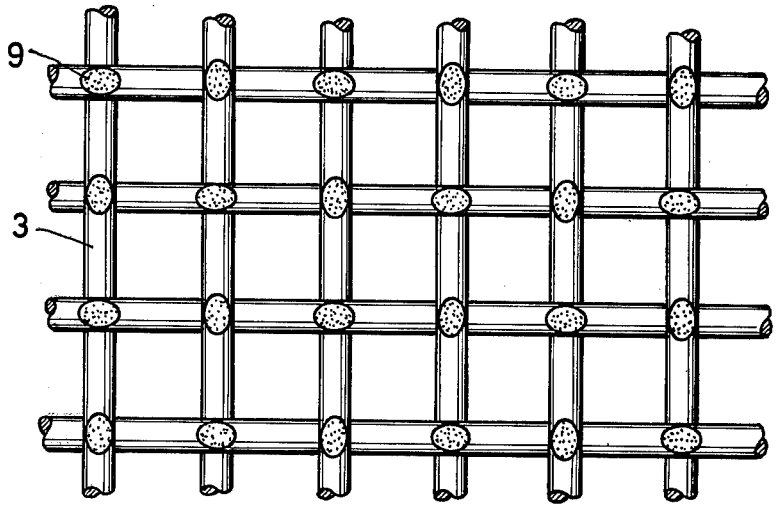
FIG. 6 is an enlarged plan view of a supporting mesh that may be employed in the arrangement of FIG. 1.

In accordance with the invention, the rough areas 8 and 9 may be produced by electroplating, by etching, or by any other useful means such as mechanical metal removing, grinding, sandblasting, or the like. It is further possible to coat or clad the surfaces, zones or areas with a friction lining 10, as illustrated in FIGS. 3 and 4. These friction linings 10 may be applied to the centrifuge basket 1, as shown in FIG. 3, and/or to the rear side of the screen as shown in FIG. 4. The friction linings may be metallic, but it is also feasible to employ plastic layers or layers of other suitable friction increasing material. In any event the rough surface may be provided on the screen or on the supporting means or on both. FIG. 6 illustrates one embodiment of the mesh 3 employed in the centrifuge of FIG. 1. In this arrangement, the rough areas 9 of the supporting or backing mesh are distributed on the raised areas of the mesh to contact the screen 2. In order to increase the size of the rough areas, the raised areas may be flattened, for example, by metal removal as illustrated in FIG. 5, so that the raised areas, which normally would be rather small, become oval shaped and thus larger, as seen in FIG. 6.

Figure 7:
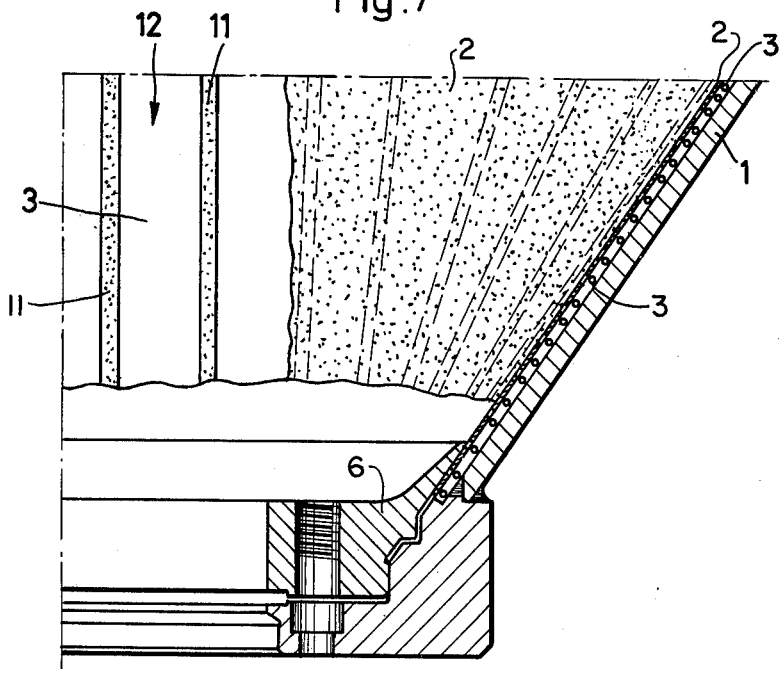
FIG. 7 is a sectional view of a portion of a modified centrifugal basket of a centrifuge in accordance with the invention, incorporating bars on the inner surface of the basket for supporting the screen.
Figure 10:
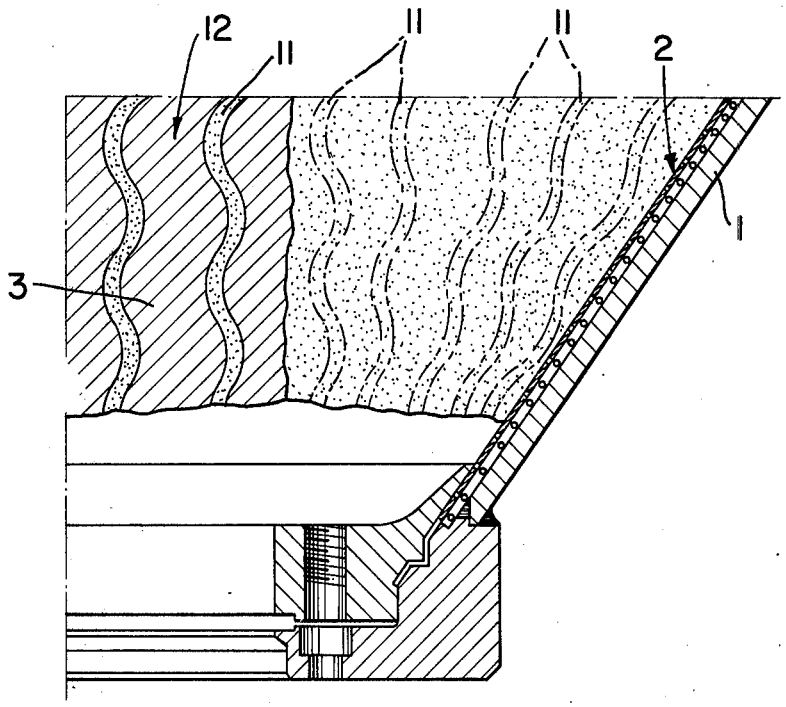
FIG. 10 is a sectional view similar to that of FIG. 7, with curved bars.

FIG. 7 shows a modification of the centrifuge basket 1 of FIG. 1, wherein bar shaped supporting devices 11 are secured to the inner surface of the centrifuge basket 1, for example, by welding or screws or the like. These supporting bars extend from the smaller diameter end of the basket to the larger diameter end thereof, and may, for example, have round or square cross sections. The surfaces of the supporting bars 11 facing toward the screen 2, that is, the radially inner sides of the bars as seen in the left portion of FIG. 7 where the cover screen 2 is broken away, are either lined along their whole lengths with friction linings, or the whole lengths thereof are completely rough. The areas 12 between the bars are filled with the supporting or backing mesh 3 in the manner illustrated in FIG. 1. The backing mesh or the backing structure illustrated in FIG. 6, may be employed depending on the load conditions under which the centrifuge is intended to operate. The bars 11 need not be straight but could, for example, extend along curved lines as shown in FIG. 10.

The present teaching to relieving the fine cover screen in a centrifuge from undesirable loads is also applicable to centrifuges in which the forces act in parallel to the screen surface and are caused by mechanical conveying devices for the product to be centrifuged. The invention is also adaptable, for example, for pusher type centrifuges in which the centrifugal force also assures that in combination with the frictional resistance, that the screen is held in place at the roughened areas between the screen and the supporting device, so that forces acting in parallel to the screen surface are directly transmitted by the frictional resistance to the supporting means.

Figure 8:
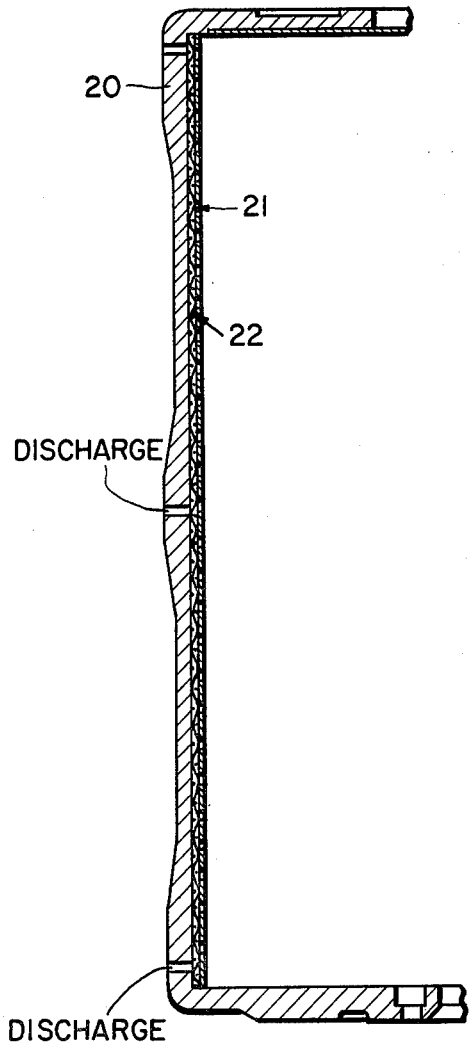
FIG. 8 is a sectional view through a portion of a cylindrical centrifugal basket incorporating the present invention.
Figure 9:
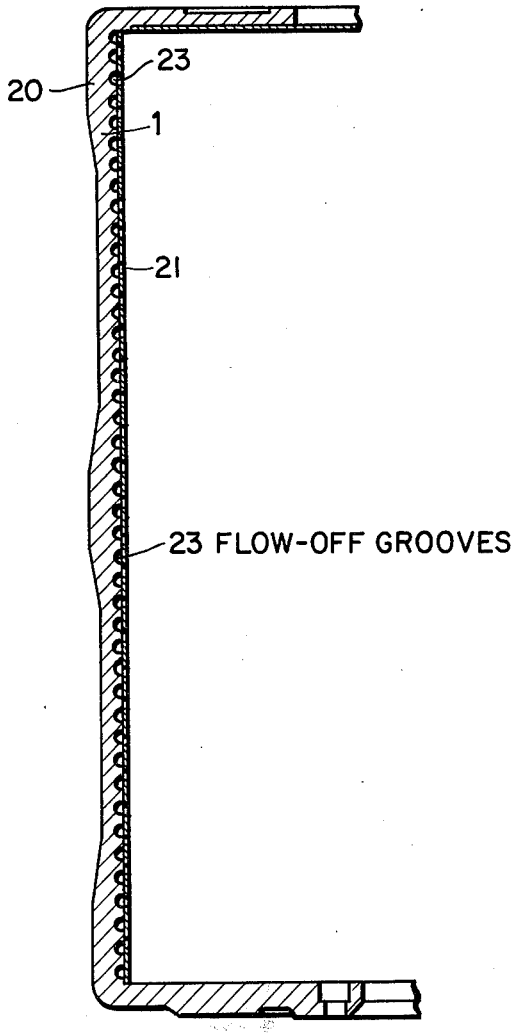
FIG. 9 is a sectional view of a modification of the centrifugal basket of FIG. 8.

As illustrated in FIGS. 8 and 9, the present invention is also useful for centrifuges having a cylindrical centrifuge drum or basket 20. The cylindrical cover screen 21, which may be of the same construction as the screen 2 in FIGS. 1 and 2, is loosely inserted in the drum. The liquid flow-off paths are provided in FIG. 8 by a wide meshed netting, such as the supporting mesh 22 of similar structure as the supporting mesh 3 in FIG. 1. In the arrangement of FIG. 9, the liquid flow-off paths are formed by grooves 23 in the wall of the centrifuge drum 20, so that the screen 21 is directly supported on the radially inner surfaces of the drum.

As in the above described embodiments of the invention, the radially outer surface zones of the screen 21 are roughened at least in some areas. In addition, or in the alternative, radially inner surface areas of the mesh 22, in the embodiment of FIG. 8, or radially inner surface zones of the drum 20, in the embodiment of FIG. 9, are roughened. This feature of the invention protects the screen against detrimental shearing stresses occurring during discharge or conveying, due to the formation of the frictional resistance at the supporting mesh 22 or at the wall of the drum 20.

The effect of the cooperating rough areas in centrifuges of the present invention, and especially in centrifuges as shown in FIGS. 8 and 9 is not only beneficial during operation but also during discharge of a centrifuge such as a sugar centrifuge because any scraping or pushing means press the screen against its supporting device in the area where the scraper or the like contacts the screen. Due to the frictional resistance provided by the rough areas, the screen cannot move or slide in the direction of the resulting shearing forces whereby respective shearing force stresses on the screen are substantially prevented since the respective forces are directly transmitted to the supporting means.

As in the arrangement of FIGS. 1 and 2, the rough surface zones or areas in the embodiments of FIGS. 8 and 9 may be achieved by electroplating, sand-blasting or grinding, or it may be caused by coating the surface areas or zones with friction increasing linings as illustrated in FIGS. 3–5. Further, when the supporting mesh 22 is employed it may be roughened at its high points and flattened in the same manner as the mesh illustrated in FIG. 6, so that the rough areas are enlarged. The screen structure in FIGS. 8 and 9 may also be of the type shown in FIG. 4.

The total size of rough area provided on the screen and/or mesh and/or on the supporting surface is of course dependent on the load to which the screen will be subjected in service. If only selected areas are roughened, then it is preferred that these areas extend in the circumferential direction of the centrifuge drum or basket.

Although the invention has been described with reference to specific example embodiments, it is to be understood that it is intended to cover all modifications and equivalents within the scope of the appended claims.

What is claimed is:

1. In a centrifuge having a rotatable means with liquid flow-off path means on the radially inner surface thereof, and a screen positioned in contact against the radially inner surface of said rotatable means, the improvement comprising a plurality of first roughened surface means on a portion of the radially outwardly facing surface of said screen and a like plurality of second roughened surface means on a corresponding radially inner surface portion of said rotatable means, said first and second roughened surface means contacting each other in a locking manner, thereby providing a frictional resistance under the influence of the centrifugal force, said frictional resistance holding the screen in place substantially uniformly over the entire surface of the screen, whereby relative movement between the screen and the rotatable means is substantially inhibited.

2. The centrifuge of claim 1, wherein said rotatable means comprise a basket, and wherein said screen rests directly on the inner surface of said basket, said liquid flow-off paths comprising grooves in the inner surface of said basket.

3. The centrifuge of claim 1, wherein said roughened surface means comprise electroplated surface areas.

4. The centrifuge of claim 1, wherein said roughened surface means comprise sand-blasted surface areas.

5. The centrifuge of claim 1, wherein said roughened surface means comprise surface areas that have been subjected to grinding.

6. The centrifuge of claim 1, wherein said roughened surface means on at least one of said screen and rotatable means comprise a layer of a material having a high coefficient of friction.

7. The centrifuge of claim 1, wherein said rotatable means comprise a centrifuge basket and a support mesh for said screen on the radially inner surface of said centrifuge basket, whereby said support mesh provides said liquid flow-off paths while simultaneously supporting said screen said further roughened surface means forming part of said support mesh.

8. The centrifuge of claim 1, wherein said rotatable means comprise a centrifuge basket which is conical, and wherein said screen is secured to said conical basket at the smaller diameter end thereof.

9. The centrifuge of claim 8, wherein said rough surface areas extend along straight lines from the smaller diameter end of said centrifuge basket to the larger diameter end thereof.

10. The centrifuge of claim 8, wherein said rough surface areas extend along curved lines from the smaller diameter end of said centrifuge basket to the larger diameter end thereof.

11. The centrifuge of claim 1, wherein said rotatable means comprise a centrifuge basket which is conical, and straight bars extending from a smaller diameter end of said centrifuge basket to the larger diameter end radially inside thereof, said straight bars supporting said screen and having roughened radially inner surfaces, said centrifuge basket further comprising supporting mesh means between said bars.

12. The centrifuge of claim 1, wherein said rotatable means comprise a centrifuge basket which is conical, and curved bars extending from the smaller diameter end of said centrifuge basket to the larger diameter end radially inside thereof, said curved bars supporting said screen and having roughened radially inner surfaces, said centrifuge basket supporting mesh means between said bars.

13. The centrifuge of claim 1, wherein said rotatable means comprise a cylindrical centrifuge drum adapted for use with mechanical discharging and conveying devices for discharging and conveying a product to be centrifuged.

14. The centrifuge of claim 13, wherein said centrifuge drum comprises said roughened surface means arranged in at least one line extending a circumferential direction with respect to said drum.

* * * * *